United States Patent [19]

Burkhardt et al.

[11] 4,047,712

[45] Sept. 13, 1977

[54] CONVEYOR-DISTRIBUTOR APPARATUS FOR FLAT ITEMS

[75] Inventors: Gisbert Burkhardt, Reichenau; Dieter Hofmann, Constance, both of Germany

[73] Assignee: Licentia Patent-Verwaltungs-G.m.b.H., Frankfurt am Main, Germany

[21] Appl. No.: 690,596

[22] Filed: May 27, 1976

[30] Foreign Application Priority Data

May 30, 1975 Germany ..... 2523835

[51] Int. Cl.[2] ..... B65H 29/60

[52] U.S. Cl. ..... 271/64; 193/46; 198/359; 198/367; 198/417; 209/DIG. 1; 214/6 D; 271/185

[58] Field of Search ..... 271/64, 184, 185, 207, 271/198, 63, 2; 198/417, 406, 359, 367, 569, 568, 560; 209/DIG. 1; 214/1 M, 6 D; 193/46, 2 R

[56] References Cited

U.S. PATENT DOCUMENTS

| | | | |
|---|---|---|---|
| 2,937,739 | 5/1960 | Levy | 271/64 X |
| 3,137,499 | 6/1964 | Maidment | 271/64 X |
| 3,446,334 | 5/1969 | Donner | 198/417 |
| 3,913,730 | 10/1975 | Gruodis et al. | 193/2 R X |

*Primary Examiner*—Bruce H. Stoner, Jr.
*Attorney, Agent, or Firm*—Spencer & Kaye

[57] ABSTRACT

A conveyor-distributor apparatus for handling flat rectangular items, has a horizontal conveyor channel; a support face defining the conveyor channel floor on which the lower edges of the substantially upright oriented items are guided; and a plurality of consecutive deflector switches arranged along the conveying path of the conveyor channel. A guiding device is connected to each deflector switch for changing the orientation of the deflected items from the position they assumed in the conveyor channel to a flat-lying, stacking position. Each guiding device is constituted by a slide that comprises a curved deflecting surface having a first surface portion which adjoins the associated deflector switch and which is in alignment with the plane of the items as they emerge from the deflector switch subsequent to their deflection thereby. The deflecting surface further has a second surface portion which is bounded by a lower terminal edge and which is inclined to the horizontal at an acute angle having an apex oriented towards the location of another, upstream-positioned slide as viewed in the conveying direction of the conveyor channel. Each slide further has a curved supporting surface intersecting the curved deflecting surface substantially at a right angle. The supporting surface has a first surface portion adjoining the support face of the conveyor channel and a second surface portion substantially following the drop curve of the items on the slide for effecting a continuous contact with the lower edge of the items as they move down on the slide.

6 Claims, 4 Drawing Figures

CONVEYOR-DISTRIBUTOR APPARATUS FOR FLAT ITEMS

BACKGROUND OF THE INVENTION

This invention relates to a conveyor-distributor apparatus for handling flat rectangular items such as letters and is of the type that has a conveyor channel in which the items are advanced in a substantially horizontal direction while guided, at their lower edge, by a supporting face forming the floor of the conveyor channel. The apparatus further has, along the conveyor channel, a plurality of successively arranged and arbitrarily operated deflector switches. With each deflector switch there is associated a guiding device in which the direction of motion and the orientation of the deflected items are so changed that the items eventually arrive in a stacking container in an orientation which is substantially perpendicular to their earlier direction of motion. In the stacking container the items lie in a face-to-face, superpositioned relationship and thus form a stack.

A conveyor-distributor apparatus of the above-outlined type which serves for the sorting and stacking of sheet-like items is known and is disclosed, for example, in U.S. Pat. No. 3,137,499. The guiding devices which are arranged between the outlets of the deflector switches and the respective stacking containers are each formed of a significantly bent deflecting shell whose hollow side is oriented downwardly, and two pairs of conveyor rollers adapted to the course of the deflector face of the shell. The deflecting surface, in the zone of its lower edge oriented towards the stacking container, forms with the horizontal an acute angle, the apex of which is oriented towards that deflector shell which is situated downstream when viewed in the direction of conveyance. The conveyor roller pairs serve for the forced feed of the items along the underside (deflecting surface) of the deflecting shell.

The above-outlined known apparatus is adapted only for handling flexible and relatively thin items. Thus, it cannot be used for letters, particularly letters of large format.

SUMMARY OF THE INVENTION

It is an object of the invention to provide an improved conveyor-distributor apparatus of the above-outlined kind which is adpated to handle rigid and relatively thick flat items, particularly letters of relatively large format and which requires a relatively simple mechanical arrangement.

This object and others to become apparent as the specification progresses are accomplished by the invention, according to which, briefly stated, each guiding device, associated with a respective deflector switch is constituted by a slide that comprises a curved deflecting surface having a first surface portion which adjoins the associated deflector switch and which is in alignment with the plane of the items as they emerge from the deflector switch subsequent to their deflection thereby. The deflecting surface further has a second surface portion which is bounded by a lower terminal edge and which is inclined to the horizontal at an acute angle having an apex oriented towards the location of another, upstream-positioned slide as viewed in the conveying direction of the conveyor channel. Each slide further has a curved supporting surface intersecting the curved deflecting surface substantially at a right angle. The supporting surface has a first surface portion adjoining the support face of the conveyor channel and a second surface portion substantially following the drop curve of the items on the slide for effecting a continuous contact with the lower edge of the items as they move down on the slide.

DESCRIPTION OF THE PREFERRED EMBODIMENTS

Figure 2:
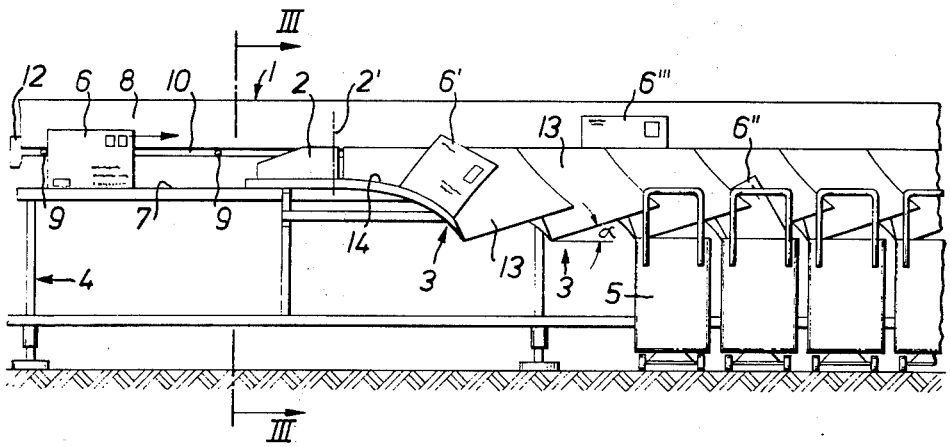
FIG. 2 is a side elevational view of the same embodiment as seen in the direction of the arrow II in FIG. 1.
Figure 1:
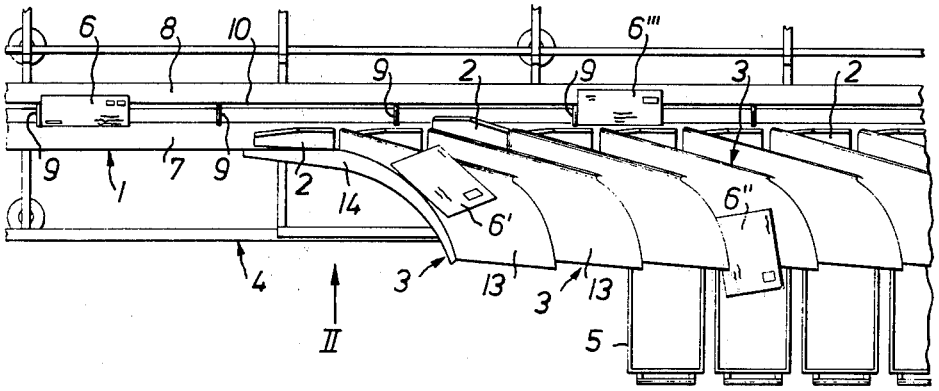
FIG. 1 is a schematic top plan view of a preferred embodiment of the invention.

Turning now to FIGS. 1 and 2, on a stand 4 there are mounted a conveyor channel 1, deflector switches 2 arranged in a series along the conveyor channel 1 and slides 3, one associated with each deflector switch 2. Under each slide 3 there is positioned a wheeled cart 5 constituting a stacking container 5 which, with the item stack formed therein, may be manually propelled to a location where further sorting or other processing of the items takes place.

The conveyor channel 1 has a support face (channel floor) 7 which serves for guiding and supporting the lower edge of the substantially upright oriented items 6. The conveyor channel 1 further has a side wall 8 against which the items lean. The deflector switches 2 are constituted by deflector gates which can be pivoted into the conveying path defined by the conveyor channel. The pivotal axis of the deflector gates 2 is designated at 2'. The actuating mechanism for the deflector gates is of known structure and is not shown for better visibility. It is noted that in FIGS. 1 and 4 the third deflector switch from the left is in the deflecting position whereas all the other switches are in the inoperative position in which they are situated clear of the conveying path of the conveyor channel 1.

Figure 3:
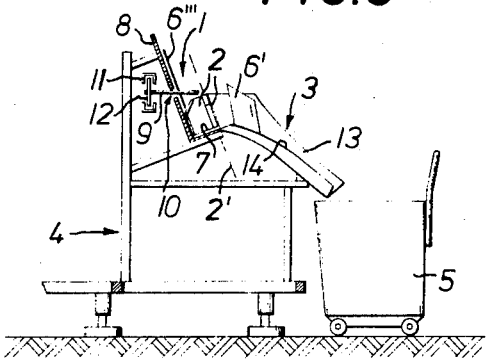
FIG. 3 is a schematic sectional view along line III—III of FIG. 2.

Turning now to FIG. 3, the support face 7 of the conveyor channel 1 is not horizontal in a direction transverse to the direction of conveyance, but slopes towards the side wall 8 at an angle of approximately 20° with respect to the horizontal to ensure that the items 6 positioned with their lower edges on the support face 7 lean against the side wall 8, as noted earlier.

The item advancing mechanism comprises pusher fingers 9 which project through a slot 10 provided in the side wall 8 which extends opposite the side of the conveyor channel where the deflector gates 2 are arranged. The fingers 9 are carried, in a manner known by itself, on an endless drive belt 12 supported on guide rails 11, as shown in FIG. 3.

Each slide 3 has two curved surfaces, namely a deflecting surface 13 and a supporting surface 14. These two surfaces intersect one another substantially at a right angle.

The deflecting surface 13 is, at its upper portion that adjoins the deflector switch 2, aligned with that inclined plane in which the items lie as they emerge from a deflector switch 2 which is in its deflecting (operative) state (FIGS. 2 and 3). Generally said upper portion is continuing the guiding face of a deflector switch in its deflecting state. In the zone of that lower edge of the deflecting surface 13, which is oriented towards the stacking container 5, the deflecting surface 13 forms with the horizontal an acute angle $\alpha$ (FIG. 2), the apex of which is oriented towards the upstream-arranged slide 3. Stated differently, the apex of $\alpha$ is oriented oppositely to the direction of item feed in the conveyor channel 1.

The supporting surface 14 adjoins at its upper part the support face 7 of the conveyor channel 1 as it may be observed in FIG. 3. In its further course the supporting surface 14 substantially follows the drop curve (sliding course) of the items on the slide, so that the lower edges of the items, as they slide downward and undergo reorientation, remain in contact with the supporting surface 14, generally in the zone of the trailing corner of the item. This drop curve is determined by the inclination of the deflecting surface 13 and the friction between that surface and the particular item. In the experimental determination of the course of the supporting surface 14, the drop curves of items having a relatively large mass and small coefficient of friction have to be taken into consideration.

By virtue of the above-described shape of the slide 3 the items are guided into the stacking container 5 in a definite stacking position without the use of positive advancing devices, thus without a forced feed. The course of motion of the items on the slide 3 may be followed by observing in the Figures, the successively positioned items 6' and 6''. The item designated at 6''' is in a still undeflected position in the conveyor channel 1.

According to a further feature of the invention, the mutual distances of the axes 2' of the deflector switches 2 may be so selected that the deflecting surfaces 13 of the successive slides 3 overlap in the manner of roofing tiles as may be observed in FIGS. 1 and 2. The advantage is a very short structural length of the distributor path. The deflector switches 2 succeed one another at such a short distance in this embodiment that the boundary (side wall) of the conveyor channel 1 which is opposite the side wall 8 is constituted by the deflector gates when in their inoperative position.

Figure 4:
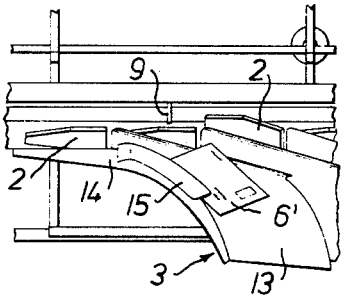
FIG. 4 is a side elevational view of a modified detail of FIG. 1.

According to a further feature of the invention, the pusher fingers 9 project to such an extent into the conveyor channel 1 (FIG. 3) that they continue to advance (push) the items 6 which are deflected by an actuated deflector gate 2 until they leave the deflector switch and are in their entirety on the respective slide 3. In this connection and also for additional reasons it is expedient to select the distance between the upper edge of the deflector gates 2 and the support face 7 smaller than the height of the lowest item handled by the apparatus. If, in case of such a dimensioning of the deflector gates 2, the upper edge (which is shown rolled-over in FIG. 1) of the slide 3 adjoins the respective deflector gate at the height of the upper edge of that deflector gate, items with a high center of gravity may tend to topple over the upper edge after being deflected from their original direction of conveyance. This tendency, however, can be counteracted by providing, as shown in FIG. 4, an additional guide wall 15 which is arranged opposite the deflecting surface 13 and which serves for guiding (restraining) the lower zone of the deflected items. In FIG. 4, the guide wall 15 is shown mounted on the supporting surface 14. It is feasible, however, to form this guide wall by appropriate shaping of the sheet which forms the supporting surface 14. It is further feasible to secure the additional guide wall serving a second, or other downstream slide 3 to the underside of that part of the immediately upstream arranged slide 3 which constitutes the deflecting surface 13.

It will be understood that the above description of the present invention is susceptible to various modifications, changes and adaptations and the same are intended to be comprehended within the meaning and range of equivalents of the appended claims.

What is claimed is:

1. In a conveyor-distributor apparatus for handling flat rectangular items, including a conveyor channel defining a substantially horizontal feed path for the items; a support face defining the conveyor channel floor on which the lower edge of the substantially upright oriented items are guided; means for advancing the items in the conveyor channel; a plurality of consecutive deflector switches arranged along the conveying path of the conveyor channel, each deflector switch having an operative position in which the item passing therethrough is deflected from the conveyor channel and an inoperative position in which the item passing therethrough is unaffected and continues to proceed in the conveyor channel; a guiding device connected to each deflector switch for changing the orientation of the deflected items from their position they assumed in the conveyor channel to a flat-lying, stacking position; the improvement wherein each guiding device is constituted by a slide comprising a. a curved deflecting surface having a first surface portion adjoining the associated deflector switch; said first surface portion being in alignment with the plane of the items as they emerge from the deflector switch subsequent to their deflection thereby; said deflecting surface further having a second surface portion bounded by a lower terminal edge; said second surface portion being inclined to the horizontal at an acute angle having an apex oriented towards the location of another upstream-positioned slide as viewed in the conveying direction of said conveyor channel; and b. a curved supporting surface intersecting said curved deflecting surface substantially at a right angle, said curved supporting surface having a first surface portion adjoining said support face of said conveyor channel and a second surface portion substantially following the drop curve of the items on the slide for effecting a continuous contact with said lower edge of said items as they move down on the slide and are reoriented thereby.

2. A conveyor-distributor apparatus as defined in claim 1, wherein said slides are in a roofing tile-like overlapping relationship.

3. A conveyor-distributor apparatus as defined in claim 1, wherein the deflector switches comprise deflector gates arranged along one side of said conveyor channel; each deflector gate being pivotally supported to be movable into said operative and inoperative positions; said deflector gate, when in said operative position, extending into the item feed path defined by said conveyor channel; said means for advancing the items in said conveyor channel comprising pusher fingers for engaging a trailing portion of each item; said pusher fingers extending into said feed path from that side of said conveyor channel which is opposite said deflector gates; said fingers projecting into said item feed path to a sufficient extent to continue to advance each item deflected by an operative deflector gate until the deflected item leaves said operative deflector gate in its entirety; said means for advancing the items further comprising an arrangement for moving said pusher fingers along said conveyor channel.

4. A conveyor-distributor apparatus as defined in claim 3, wherein each deflector gate has an upper edge and wherein the distance between said upper edge and said support face defining the conveyor channel floor is less than the height of the smallest item handled by said apparatus.

5. A conveyor-distributor apparatus as defined in claim 3, wherein said deflector gates, when in said inoperative position, form a substantially continuous side wall of said conveyor channel.

6. A conveyor-distributor apparatus as defined in claim 1, further comprising a guide wall supported on each slide opposite the deflecting surface thereof for guiding a lower zone of each item deflected by the respective deflector switch.

* * * * *